US012618602B2

(12) United States Patent
Tauber et al.

(10) Patent No.: US 12,618,602 B2
(45) Date of Patent: May 5, 2026

(54) ELECTRICAL TRANSPORT REFRIGERATION UNIT

(71) Applicant: Sunswap Ltd, Leatherhead (GB)

(72) Inventors: Nikolai Tauber, Leatherhead (GB); Robin Bernard-Grahame, Leatherhead (GB); Adam Payne, Leatherhead (GB); Noah Tucker, Leatherhead (GB)

(73) Assignee: Sunswap Ltd. (GB)

( * ) Notice: Subject to any disclaimer, the term of this patent is extended or adjusted under 35 U.S.C. 154(b) by 78 days.

(21) Appl. No.: 18/688,432

(22) PCT Filed: Aug. 15, 2022

(86) PCT No.: PCT/EP2022/072781

§ 371 (c)(1),
(2) Date: Mar. 1, 2024

(87) PCT Pub. No.: WO2023/030869

PCT Pub. Date: Mar. 9, 2023

(65) Prior Publication Data

US 2024/0369282 A1 Nov. 7, 2024

(30) Foreign Application Priority Data

Sep. 3, 2021 (GB) ..... 2112587

(51) Int. Cl.
*F25D 11/00* (2006.01)

(52) U.S. Cl.
CPC ..... *F25D 11/003* (2013.01); *F25D 2400/40* (2013.01)

(58) Field of Classification Search
CPC ..... F25D 11/003; F25D 2400/40; B60H 1/00378; B60H 1/00278
See application file for complete search history.

(56) References Cited

U.S. PATENT DOCUMENTS 12,061,039 B1 * 8/2024 Fisher ..... F25D 23/067
2006/0023480 A1 * 2/2006 Plummer ..... B60H 1/00278 363/146

(Continued)

FOREIGN PATENT DOCUMENTS

EP 3536552 A1 9/2019
EP 3543627 A1 9/2019

(Continued)

OTHER PUBLICATIONS

UKIPO Search Report dated Jun. 13, 2022, for Application No. GB2112587.7.

(Continued)

*Primary Examiner* — Elizabeth J Martin
(74) *Attorney, Agent, or Firm* — Conley Rose, P.C.

(57) ABSTRACT

An electric refrigeration unit includes a framework for attaching to a mobile enclosure such as a vehicle or trailer that is served by the electrical refrigeration unit, a refrigeration system for cooling and/or heating the interior of the mobile enclosure, and one or more rechargeable battery modules for powering the refrigeration system, wherein the framework supports the refrigeration system and battery modules. The framework may define a first compartment in which the refrigeration system is located and a second compartment in which the battery modules are located, where the second compartment is arranged to be dry. The framework may provide a battery racking space the front face of which is open or configurable open allowing access to the battery modules.

18 Claims, 12 Drawing Sheets

(56) References Cited

U.S. PATENT DOCUMENTS

| | | | | |
|---|---|---|---|---|
| 2019/0210424 | A1* | 7/2019 | Stannard | B60H 1/00878 |
| 2019/0214691 | A1* | 7/2019 | Saroka | H01M 10/6554 |
| 2021/0078387 | A1* | 3/2021 | Chopko | B60H 1/00014 |
| 2021/0119282 | A1* | 4/2021 | Wünsche | H01M 10/647 |
| 2021/0293460 | A1* | 9/2021 | Uehara | B60H 1/00978 |

FOREIGN PATENT DOCUMENTS

| | | | |
|---|---|---|---|
| EP | 3647087 | A1 | 5/2020 |
| GB | 2595970 | A | 12/2021 |
| WO | 2021/127647 | A1 | 6/2021 |
| WO | 2021/244832 | A1 | 12/2021 |

OTHER PUBLICATIONS

UKIPO Examination Report dated Oct. 10, 2022, for Application No. GB2112587.7.

International Search Report and Written Opinion dated Sep. 28, 2022, for Application No. PCT/EP/2022/072781.

* cited by examiner $$V = \left(\sqrt{R^2 - \left(\frac{W}{2}\right)^2} - L\right) \cdot W \cdot H$$

ELECTRICAL TRANSPORT REFRIGERATION UNIT

CROSS-REFERENCE TO RELATED APPLICATIONS

The present application is a 35 U.S.C. § 371 national stage application of PCT/EP2022/072781 filed Aug. 15, 2022, entitled "Electrical Transport Refrigeration Unit", which claims priority to United Kingdom patent application No. GB 2112587.7 filed Sep. 3, 2021, both of which are hereby incorporated herein by reference in their entirety.

The present invention relates to an electrical transport refrigeration unit, and in particular to an electrical transport refrigeration unit including a framework for providing structural support to various elements of the electrical transport refrigeration unit, including rechargeable batteries, and for attachment to the vehicle or trailer that is served by the refrigeration unit. The electrical refrigeration unit being of a type configured to draw power from the rechargeable batteries in cooling the interior of a mobile enclosure, such as in a trailer or lorry.

Mobile refrigeration units are known in various industries. For instance, Transport Refrigeration Units (TRUs) play an important role for the food distribution industry in delivering fresh, frozen, and other perishable food from field to market, typically from food processors to wholesale distribution hubs and/or refrigerated storage, and then onto retail and food service industries. These are found used with small rigid vans right through to articulated trucks pulling a refrigerated container. Often, a TRU may be used with a tractor unit pulling a semi-trailer (known as a semi-trailer truck in the US, an articulated lorry in the UK and various other names in other countries), where the TRU is added to a specially designed and insulated trailer according to a particular customer's specifications. The TRU typically consists of four primary components for the refrigeration cycle: evaporator, compressor, condenser, and expansion valve. When the compressor is driven, these combine to chill air in one or more compartments in the interior of the trailer to cool the contents.

Currently most TRUs are diesel driven, particularly when used with trailers. Such units are well established in the industry, but have a number of drawbacks including noise and exhaust emissions. To address the inefficiencies associated with regular diesel-driven TRUs, some hybrid designs and eTRUs have been proposed using solar power and/or batteries to supplement and/or supplant other power sources in powering the refrigeration unit. More recently, the present applicants have proposed in PCT/EP2021/062825, filed 14 May 2021, entitled "Electric Mobile Refrigeration Unit", the entire contents of which are hereby incorporated by reference in their entirety, a refrigeration unit powered by rechargeable batteries, optionally supplemented by solar, to minimize or eliminate the need for diesel power from the tractor unit or separate generator to power the refrigeration system.

Despite the advent of battery powered TRUs, relatively little thought has hitherto gone into how to most effectively accommodate the batteries in such systems. Wherever they are positioned, batteries must be secure and protected from the elements. Typically batteries are heavy and require a strong support framework. Accessibility is an important concept in battery placement, e.g. for serviceability. Also efficiently packing batteries is important, to avoid taking up space that could otherwise be used for other purposes, e.g. the payload. Accordingly, many prior art arrangements place batteries in racks under the trailer. However, such arrangements have the disadvantage of that the space under the trailer is often already used for other purposes. Another disadvantage is that provisioning and fitting the system to a trailer becomes more difficult, as separate units are required for the TRU containing the refrigeration system which sits at the front of the trailer, and the battery rack under the trailer, with connections between them then needing to be made. Various industry standards exist for the trailer, e.g. EU Commission regulation no 1230/2012, in terms of dimensions, positioning and interfacing to the TRU and tractor unit. However no standards currently exist for battery racking systems underneath the trailer or indeed anywhere on the trailer. Thus, a manufacturer must collaborate with trailer manufacturers in provisioning a racking system for each specific trailer, rather than being able to ship a unit that complies with the relevant standards which can be relied on to integrate with any compliant trailer and so can be shipped and fitted by the end user of the trailer.

It should be noted that it is known in the prior art for diesel driven TRUs to include small batteries to power the electronics and startup of the refrigeration system. However, these batteries are small and not intended or capable of providing the main source of power to the refrigeration system, and so the fitting such a small battery into the confines of the TRU or achieving high battery densities becomes less of a concern. The present disclosure is concerned with cases where the TRU's primary source of power is from battery power, possibly supplemented by solar or other sources, and it is desired to incorporate a large volume of battery power capable of driving the refrigeration system, i.e. as sometimes called "traction batteries", into the TRU itself in an optimum way.

The present disclosure aims to address these and other problems in the prior art.

According to a first aspect of the present disclosure, there is provided an electric refrigeration unit comprising:

- a framework for attaching to a mobile enclosure;
- a refrigeration system for cooling and/or heating the interior of the mobile enclosure; and
- one or more rechargeable battery modules for powering the refrigeration system, wherein the framework supports the refrigeration system and battery modules.

The design of trailers, their attachment to tractor units and various standards applicable to trailers place various constraints on the dimensions and layout of a TRU, i.e. it has typically a shallow box shape, i.e. depth dimension smaller than other dimensions, with a flat, generally rectangular back face for placing up against the wall of the enclosure and a flat, generally rectangular, but possibly curved (due to the enclosure pivoting), front face, which in use is fixed in the vertical plane when attached to a side wall of the enclosure, e.g. trailer or lorry. The framework may comprise main members at the edges of this box shape connected at the vertices. Thus, front and rear faces are the largest. Further main members may be provided spaced forwardly of the rear framework to help brace the framework and prevent torsion and bending, and generally increase rigidity and strength.

It is preferred that framework allows access to the one or more batteries through one or both of these largest faces. The framework comprises structural members that are generally permanently fixed together, e.g. welded metal members, to increase the structural integrity. Preferably, the area through which the one or more batteries are accessed is unobstructed by members of the framework, i.e. when constructing or maintaining the unit, the battery can be offered up to the position in which it is ultimately fixed to the framework unobstructed by members or neighboring batteries in that layer of batteries. This may for instance comprise of advancing the one or more battery modules rearwardly into the space allocated for the battery in the framework before fixing it in position. In embodiments the TRU refrigeration system is capable of running solely on battery power from the batteries in the TRU (optionally supplemented by solar) to cool the enclosure for a journey, without any power input from an ICE, axle re-gen systems, or batteries mounted external to the TRU), although in other embodiments, other power sources may be used to supplement the batteries in the TRU. Thus the present embodiments are advantageous in making efficient use of available space in a TRU, particularly where the battery capacity is large, e.g. preferably the battery capacity of the TRU for powering the refrigeration system may greater than 20 kWh, or in some examples greater than 60 kWh, or in some further examples, greater than 120 kWh.

In an embodiment, the framework defines a first compartment in which the refrigeration system is located and a second compartment in which the one or more battery modules are located.

This separation between compartments and the provision of a dedicated volume in the TRU for batteries is preferable to optimize the packing of batteries and make maximum use of the limited space available in the TRU that is not needed for other components, e.g. the refrigeration system. As discussed, the space within the unit is typically is shallow, such that a dedicated volume for the batteries will also be relatively shallow, i.e. having a smaller depth than its width or height dimensions. Typically the battery modules are prismatic, i.e. cuboid in shape, such that multiple modules of the same dimensions can efficiently be packed in an array, i.e. one or more rows and one or more columns of batteries in a cuboid overall battery volume. Alternatively, a single battery module can occupy that cuboid volume, e.g. where the battery module is large. Often a single layer of batteries in such an array will be preferred, although as discussed, further layers may be provisioned if desired, for instance one layer of one or more batteries in front of another layer of one or more batteries.

In an embodiment, the second compartment is arranged to be dry. A wall or other barrier may be provided to separate the first and second compartments. The framework and this wall and other walls provided by the TRU and/or trailer may combine to completely or partly enclose the second compartment, i.e. to protect and/or seal it from the other compartments and the wider environment, to prevent water or other liquids entering the compartment that may be encountered during use. The first compartment may therefore be made open the environment to some degree, which is typically needed so that external airflow can reach components of the refrigeration system.

In an embodiment, the first compartment is above the second compartment and separated by a tray arranged to collect liquids that collect in the first compartment and drain them away from the second compartment. The upper compartment houses the refrigeration system and can be expected to be exposed to liquids during use (i.e. it is to some extend open to the elements to allow airflow into the TRU for the condenser, and may suffer leakage of coolant, etc.). The tray collects any liquid that forms in the upper compartment and preferably channels it outside the TRU, e.g. through a hose or channel running through the lower compartment to the underside of the TRU, where the liquid can drain from the TRU.

In an embodiment, the framework provides a battery racking space the front face of which is open or configurable open allowing access to the one or more battery modules. Thus, the one or more batteries may "slot" into position in the battery racking space by advancing them front to rear unobstructed by the framework. It will be appreciated that in use the TRU will include a housing or cover and possibly other components mounted across the front of the battery volume, which would have to be removed before the battery modules could be accessed. The slots may be defined by walls, e.g. underneath and at the sides of the batteries to support them, or may be clamped in position without the need for walls. Preferably the battery modules are supported such that no battery module bears the weight of any other battery module.

In an embodiment, framework comprises battery support members at the rear of the unit to which the or each battery module is fixed. By clamping the battery modules to the support members at the rear, each battery module is positioned in a virtual slot, without the need for any peripheral supporting structure, e.g. a shelf under the battery module, which allows the maximum space to be taken up by the batteries themselves and further simplifies construction and flexibility in configuring the battery volume.

While it is preferred that the framework is open at the front and the battery modules clamp to the support members at the rear, in other examples, the support members may be moved to the front, and the battery modules introduced from the rear with optionally recesses at the front allowing the modules to be accepted between and fixed to the support members. However, clearly in this case, the TRU would need to be dismounted from the trailer before accessing the battery modules, which is a disadvantage compared to accessing them from the front.

In an embodiment, the or each battery module has a recessed edge portion at opposed sides at the rear, wherein the battery support members are received in the recessed portions.

In an embodiment, at least one fastener which is accessible to an operator at the front of the battery module fixes the battery module to the battery support members at the rear of the battery module.

In an embodiment, each fastener comprises a member which passes through a through hole or recess in the side casing of the battery module from front to rear. Thus, for instance, bolts may pass through holes in the sides of the batteries, where the head of the bolt is accessible at the front of the battery module for the operator to turn, and the rear of the bolt screws into a battery support member. Other suitable fixings may be used, e.g. employing cams, bayonet fittings, quick release fittings, etc.

In an embodiment, there are plural battery modules independently supported one above the other such in a column that no battery module bears the weight of any other battery module in that column. This is important where a large array of battery modules is used to fill the battery volume, i.e. multiple rows, as battery modules may weigh tens of kg, and battery modules are typically not designed and not capable of bearing such weights without damage.

In an embodiment, the unit comprising at least three laterally spaced support members with two columns of battery modules supported between adjacent pairs of support members. Thus, a single support member may support the battery modules in the columns on either side of it.

In an embodiment, the battery modules comprise plural battery cells, the cells being in a side by side arrangement when the modules are fixed in the unit. Thus, the battery cells may be prismatic or pouch form and are arranged in a bookshelf manner, with each battery cell in a module being side by side and so not bearing the weight of any other cell, with the terminals facing forward. In other examples, the battery cells may be cylindrical, arranged in an array, again with the terminal facing forwards. Where cylindrical cells are used, these typically would be individually supported in the casing, would be shorter than prismatic cells and/or not have the recess in the casing.

Where the battery module comprises prismatic cells in a side by side arrangement, their internal connections and battery management system within the module for managing the cells are preferably located on "top" (using conventional nomenclature) of the cells with the side walls of the module having a relatively thick, e.g. 1 to 3 cm, casing, e.g. of aluminum to protect the cells and conduct away heat, in which the recesses and through holes are formed by which they can be mounted in the present arrangement. In an EV layout, battery cells are typically arranged in a horizontal array with the contacts on top. Compared with this, it can be seen that in the present arrangement, the battery modules are turned on their side so as to be in a vertical array and with what is conventionally the "top" of the module, e.g. the surface with the electrical connections, now side on and facing the front (i.e. the front face of the TRU which typically, though not necessarily, faces the forward direction of travel of the trailer or enclosure to which it is mounted). As described, the arrangement of prismatic cells in a book case arrangement and the battery racking system providing support for each battery module alleviates the problem of battery weight, which does not arise in the horizontal array in known EV systems, whilst providing a dense, accessible battery storage volume in the TRU.

In an embodiment, the unit comprising at least one busbar, arranged to extend across the front face of the battery modules for making electrical connection to plural battery modules. Typically the bus bar extends across the front faces of the battery modules, e.g. horizontally across each row of battery modules, or vertically across each column of battery modules, although other arrangements are possible. Thus, when the battery modules have been fixed in position in the battery racking space, the busbar can be installed.

In an embodiment, a sub-frame movably or removably attaches to the framework across the front face of the battery racking space for supporting electronics and/or additional battery modules. Typically the battery volume extends across most of the width of the TRU, e.g. between 50% and 90% of the width, to make best use of the space in the TRU. Where the front face of the TRU is curved, this leaves additional space in the central region where the curvature provides additional space. This may conveniently be used to house the power electronics, e.g. contactors for selectively connecting battery modules to a DC bus for powering the refrigeration system and/or receiving power from solar cells or AC grid supply when at the depot, and a system controller for controlling these operations, and providing a user interface and communications with a remote software platform for control or reporting. The rack is removable to provide unobstructed access to the battery modules behind.

In an embodiment, the framework comprises interconnected vertical and cross members defining a rear framework portion for attaching to the trailer, and vertical side support members at each side of the unit spaced forwardly of and connected to the rear framework to brace the framework.

In an embodiment, framework further comprises curved cross members connecting the side support members.

In an embodiment, the curved cross members are concentric with a constant radius from a king pin connection to the trailer.

In an embodiment, a heat exchange plate is mounted in-between the battery support members and in thermal contact with the battery modules and is arranged to thermally condition the batteries. Thus, the bottom surface of the battery module casing, between the recesses that receive the battery support members, can contact the heat exchange plates to allow battery thermal management. This again is very space efficient.

In an embodiment, the forward vertical side support members are positioned outboard of the lateral boundaries of the battery racking space so as not to obstruct the open face of the battery racking space. In conventional TRUs, vertical members exist to brace the overall framework, but are typically located relatively far inboard. Here, they are moved outboard to avoid obstructing the face.

In an embodiment, the battery racking space does not extend laterally as far as the rear vertical members of the framework leaving a gap through which mounting fixtures of the rear vertical members can be accessed to fix the TRU to the enclosure.

In an embodiment, the battery modules are arranged in an array of plural rows and columns.

In an embodiment, there are plural layers of one or more battery modules front to back, wherein the front layer optionally has a reduced width compared with the rear layer.

In an embodiment, the sub-frame has a hinged connection to the framework or is otherwise detachable to allow it to be moved to access the one or more battery modules.

A second aspect of the disclosure relates to a method of providing a temperature controlled payload at a destination using the refrigeration unit described above, comprising powering the refrigeration system with the one or more battery modules to control the temperature of the payload in the mobile enclosure whilst transporting it to the destination.

It will be appreciated that any features expressed herein as being provided "in one example" or "in an embodiment" or as being "preferable" may be provided in combination with any one or more other such features together with any one or more of the aspects of the present disclosure.

Embodiments of the present disclosure will now be described by way of example with reference to the accompanying drawings, in which.

Figure 1:
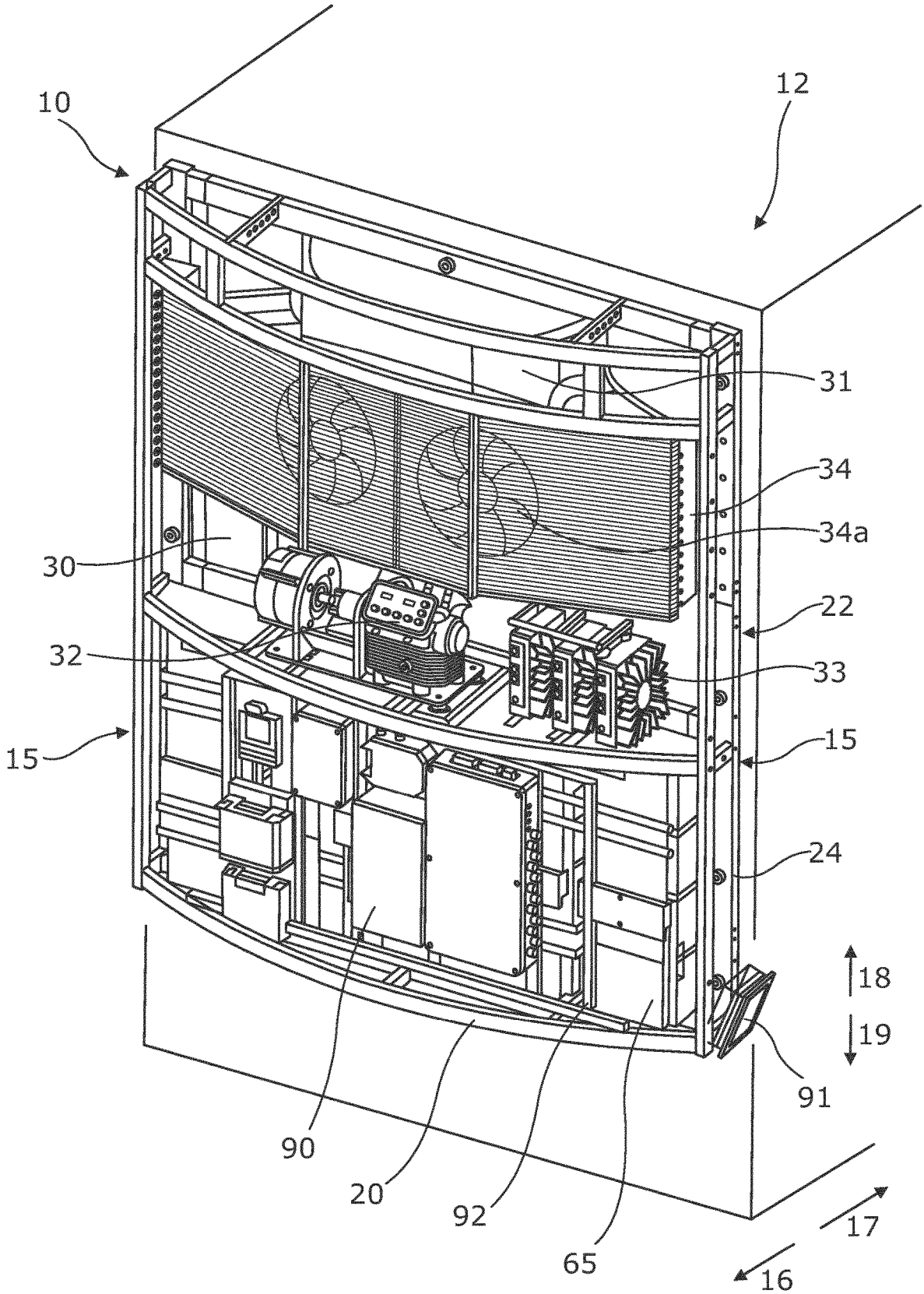
FIG. 1 shows a perspective view of an example from the front of an example of a TRU according to an embodiment of the disclosure attached to the front end of a trailer.

FIG. 1 shows a perspective view of an example of a transport refrigeration unit 10, attached to the front of a semi-trailer 12 of the sort that can be attached to and pulled by a tractor unit (not shown) to transport goods loaded to the interior of the trailer via doors at the rear of the trailer, where the TRU 10 implements a system for refrigerating the interior of the trailer. (Generally in the following description references to the "front" are in the direction of arrow 16; the "rear", arrow 17; the "top", arrow 18; the "bottom", arrow 19 and the "sides", numerals 15.) It will be appreciated that the TRU may equally be attached to other vehicles types, such as rigid body trucks, vans and lorries and may be generally applicable to cooling the interior of any enclosure. Although the unit has been described as cooling the interior of the trailer, it may also be arranged to heat the interior of the trailer.

Figure 2A:
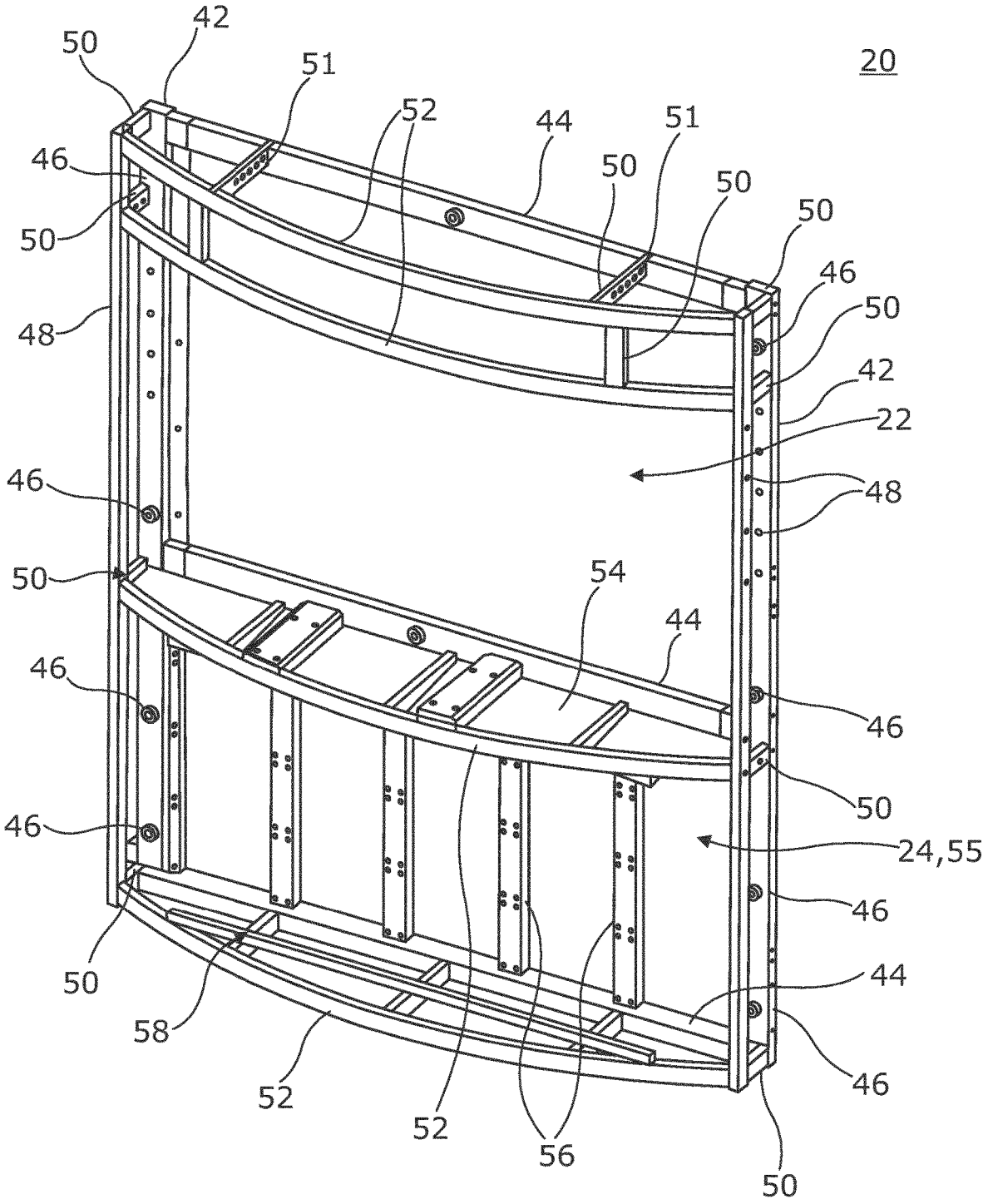
FIGS. 2A and 2B show perspective views from respectively the front, top and side and from the front, bottom, and side of a support framework for the TRU of FIG. 1.
Figure 2B:
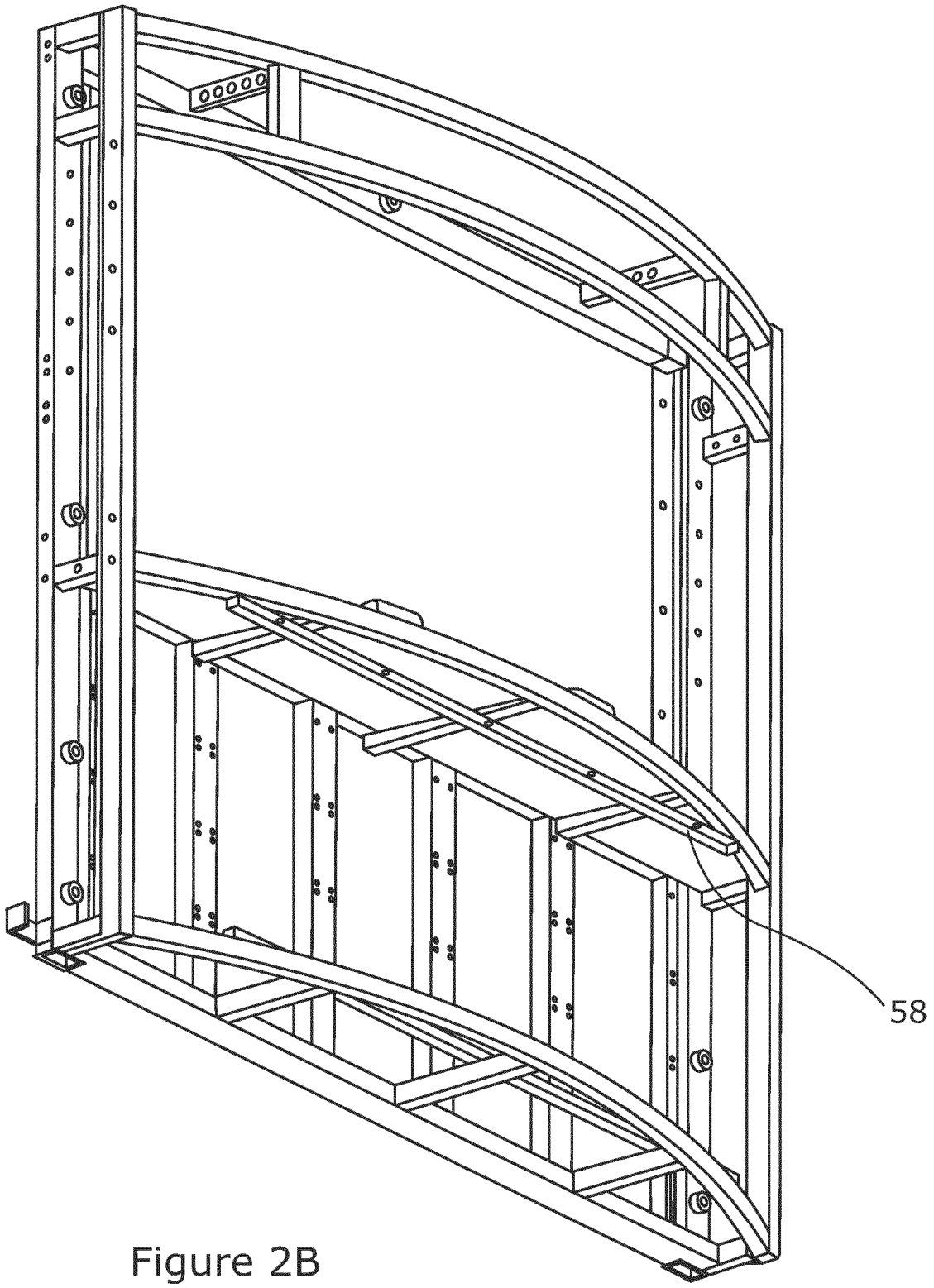

The TRU 10 comprises a structural framework 20, shown in more detail in FIGS. 2A and 2B which supports the various elements of the unit and which provides attachment points to the trailer. The framework 20 generally defines an upper compartment 22 and a lower compartment 24. The upper compartment 22 houses the refrigeration system 30 comprising the four primary components for the refrigeration cycle in a vapor compression refrigeration system, i.e. evaporator 31, compressor 32 (here shown driven by a separate compressor motor via a shaft), condenser 34, and expansion valve (not shown). When the compressor 32 is driven, these combine to chill air in the interior of the trailer 12 to cool the contents. The lower compartment 24 houses one or more rechargeable batteries modules 65 and power electronics 90 for charging the batteries (e.g. from AC grid when at the depot and/or from solar power attached to the trailer or at the depot), providing power to the refrigeration system 30 (i.e. to drive the compressor and fans) and/or exporting power from the batteries to the grid at the depot. In use, a cover (not shown) is attached over the framework to protect it from the elements.

FIGS. 2A and 2B shows the framework in more detail from the front and rear respectively. At the rear of the framework, vertical members 42 are positioned at both sides of the TRU running from top to bottom. Cross members 44 connect the vertical members 42 at the top, bottom and at an intermediate position (generally corresponding to the boundary between the top compartment 22 and lower compartment 24. This provides a generally flat, rectangular rear portion of the framework adapted to fit against and fix to end of the trailer via mounting holes 46.

Figure 8:
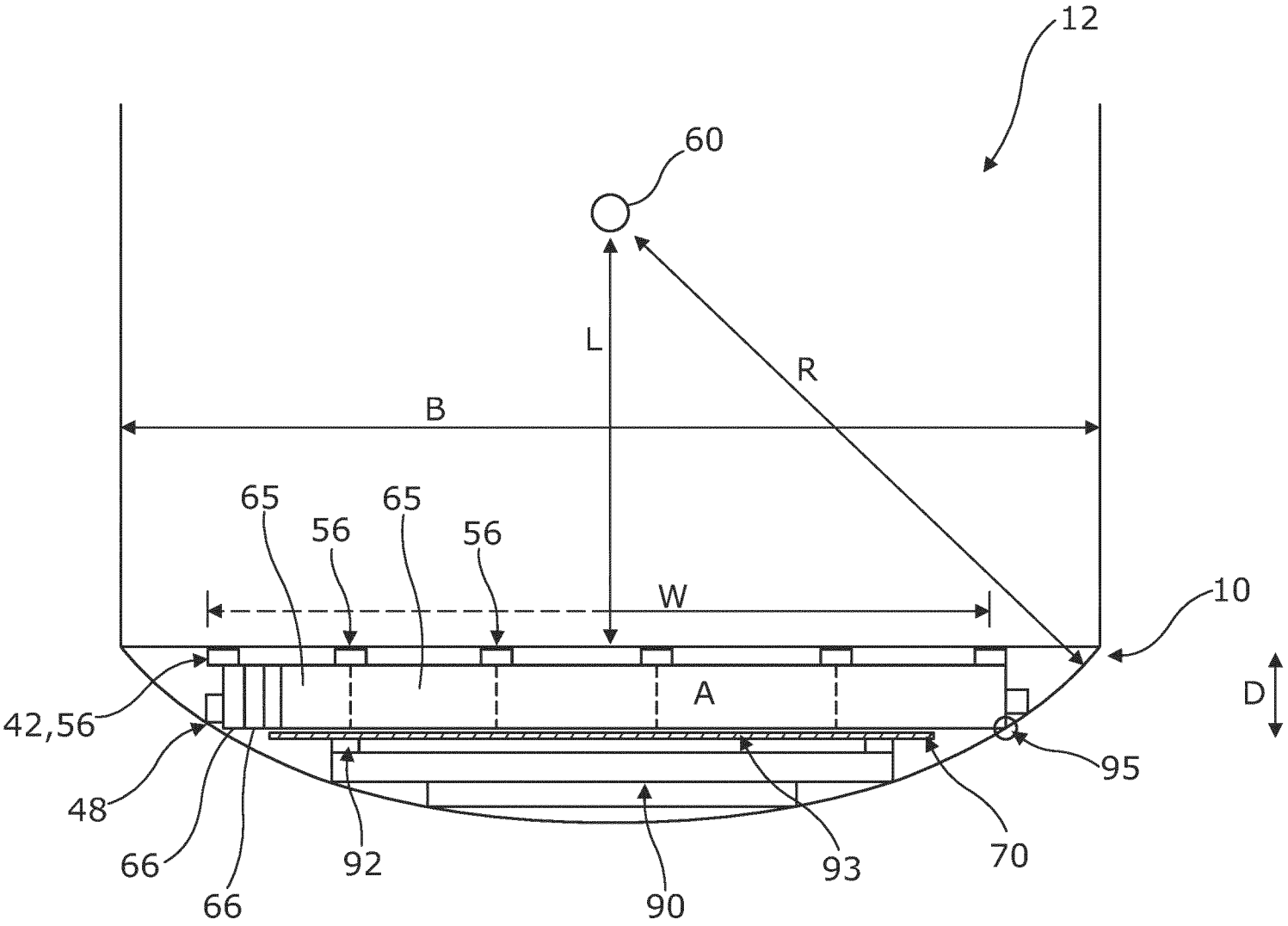
FIG. 8 shows a horizontal cross section of the TRU attached to the trailer illustrating how the battery volume occupies the available volume in the TRU under various constraints.

At the front of the framework, vertical bracing members 48 are positioned at each side, connected to and spaced forward from the rear vertical members 42 by struts 50. Curved connecting members 52 extend between the vertical bracing members 48. As shown in FIG. 8, the curvature is defined by the distance to the kingpin 60, i.e. the point about which the trailer pivots relative to the tractor, which defines a volume adjacent the front end of the trailer which the TRU can occupy (as is generally known in the art). In the present example, the TRU conforms to EU Commission regulation no 1230/2012 and so the radius from kingpin to curved front surface of the TRU will be a maximum of 2.04 m and the width of the trailer and hence TRU is also fixed. These connecting member 52 generally correspond in position with the rear cross members 44. Further struts 50 may connect the cross members and connecting members to strengthen the framework. Member(s) at the top of the framework may have attachment point(s) 51 for hoisting the TRU in position for attachment to the front of the trailer. A tray 54 is located between the top compartment 22 and lower compartment 24 attached to the cross member 44 and connecting member 52. This could be a structural element, e.g. comprising metal plate to help brace the overall framework, and/or could comprise a plastic tray or similar.

The structural members provide support and attachment points for the various component of the system, as described herein. For instance, various components of the refrigeration system can be mounted to the vertical supports. FIG. 1 shows the condenser fan unit 34*a* mounting to the rear vertical support members, but equally it could mount to the curved cross members 52 and/or vertical bracing member 48, which may make it easier to access the fasteners to remove it and gain access to the components behind it. Where the tray is structural, various components can be mounted to the tray, such as the compressor 32 and battery chargers 33, but equally these can be mounted to the framework.

It will be appreciated that different numbers and arrangements of support members may be used.

A battery rack 55 is formed in the lower compartment 24 defining a battery racking space for receiving battery modules. The battery rack 55 comprises vertical battery support members 56 positioned at the rear of the framework and spaced across the width of the framework 20, extending between the lowermost and intermediate cross members 44. Whilst it is preferred that the supports are vertical, in other examples, these support members may be horizontal or differently arranged. These members 56 define the rear of the battery rack 55. The outermost support members 56 may be integrated with the rear vertical support members in some instances if the battery modules are to extend right to the sides of the framework. However, it is preferred to leave an adequate gap, so that the fixing points 46 in the rear support members are easily accessible, e.g. for a tool to bolt the framework to the trailer. The battery rack 55 also optionally has horizontal members 58 that extend across some or all of the width of the rack along the top and bottom front edges of the rack. As described below, these may be used to support the sub-frame 92 for the power electronics, but other mounting arrangements may be used.

Figure 3A:
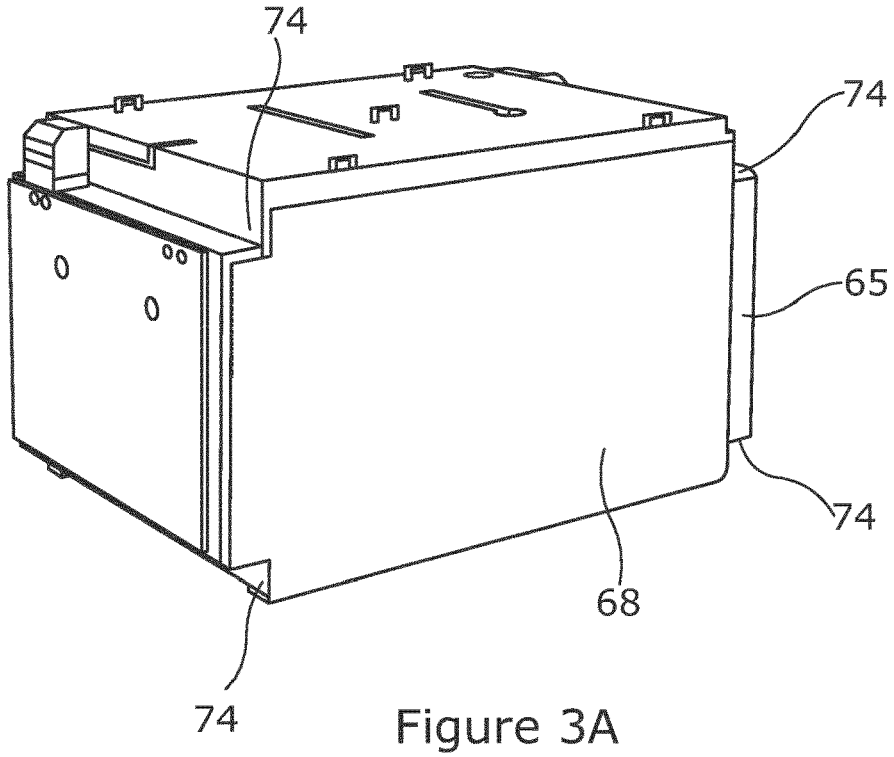
FIG. 3A shows a perspective view of an example of a battery module in the form of a cell stack suitable for use with the TRU of FIG. 1
Figure 3B:
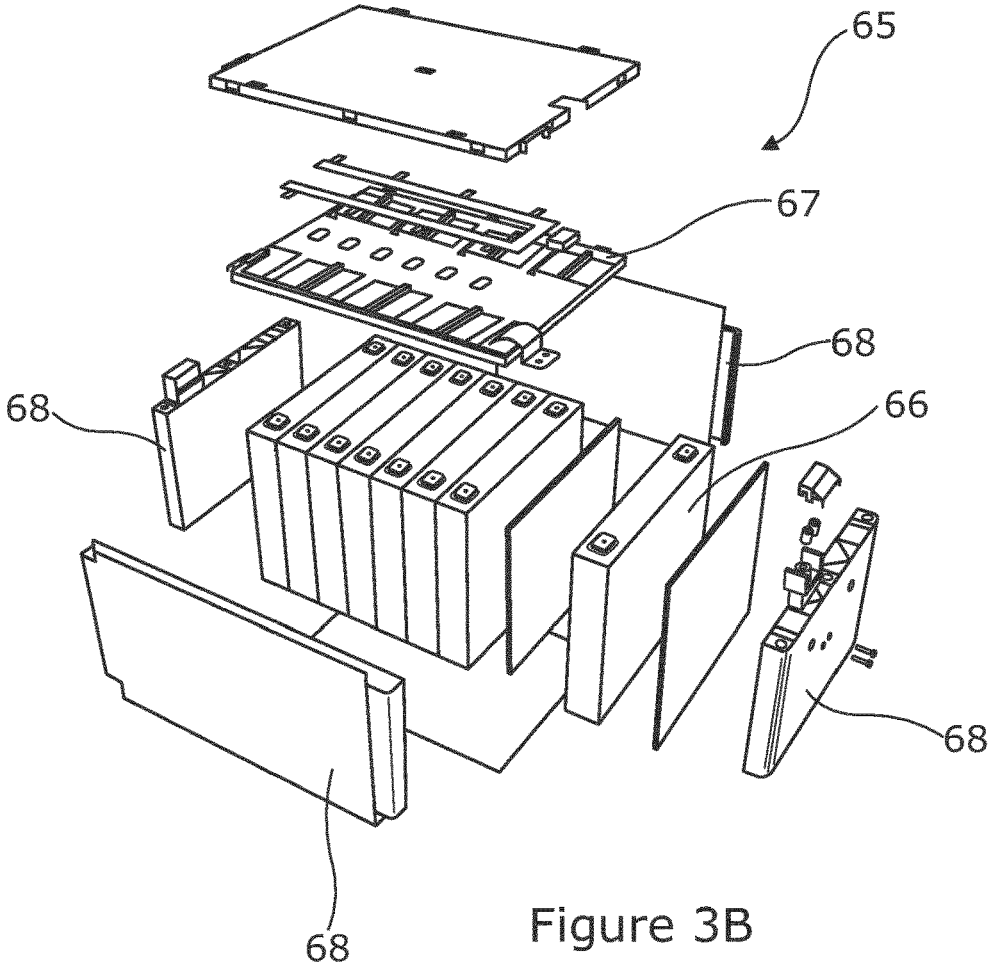
FIG. 3B shows an exploded view of the battery module.

FIG. 3A shows an individual battery module for fitting in the battery rack 55 and FIG. 3B shows an exploded view. As used herein, "battery module" means a collection of battery cells in a physical unit however arranged. "Battery" as used herein generally refers to the physical unit, i.e. the battery modules, unless the context dictates otherwise and/or the distinction between module and individual cells is not important. In the present example, the battery module is a cell stack which comprises a stack of plural prismatic battery cells 66 side by side within an enclosure with a DC bus for connecting the cells and external connectors 67 at the top of the stack. The module may have an internal Battery Management System for managing the cells. Alternatively, as is the case in the present example, the cell stack is arranged to be wired to an external, central Battery Management System. The enclosure for the cells in this example is an aluminum or plastic casing 68 extending around the sides of the cells and structurally supporting the cells, but leaving their bottom surfaces exposed to provide a heating/cooling interface, e.g. for conduction to a cooling plate 73 (described below) or convection to ambient, allowing heat to be conducted away from the battery cells. The example of FIG. 3B shows 8 prismatic cells, e.g. each having a voltage of 3.2V and 100 Ah capacity, pre-assembled by the manufacturer into a 25 V cell stack. Other arrangements of the battery modules are possible. For instance, cylindrical cells may be used, or pouch cells. As discussed below, it is preferred that the cells are side-by-side.

Figure 4:
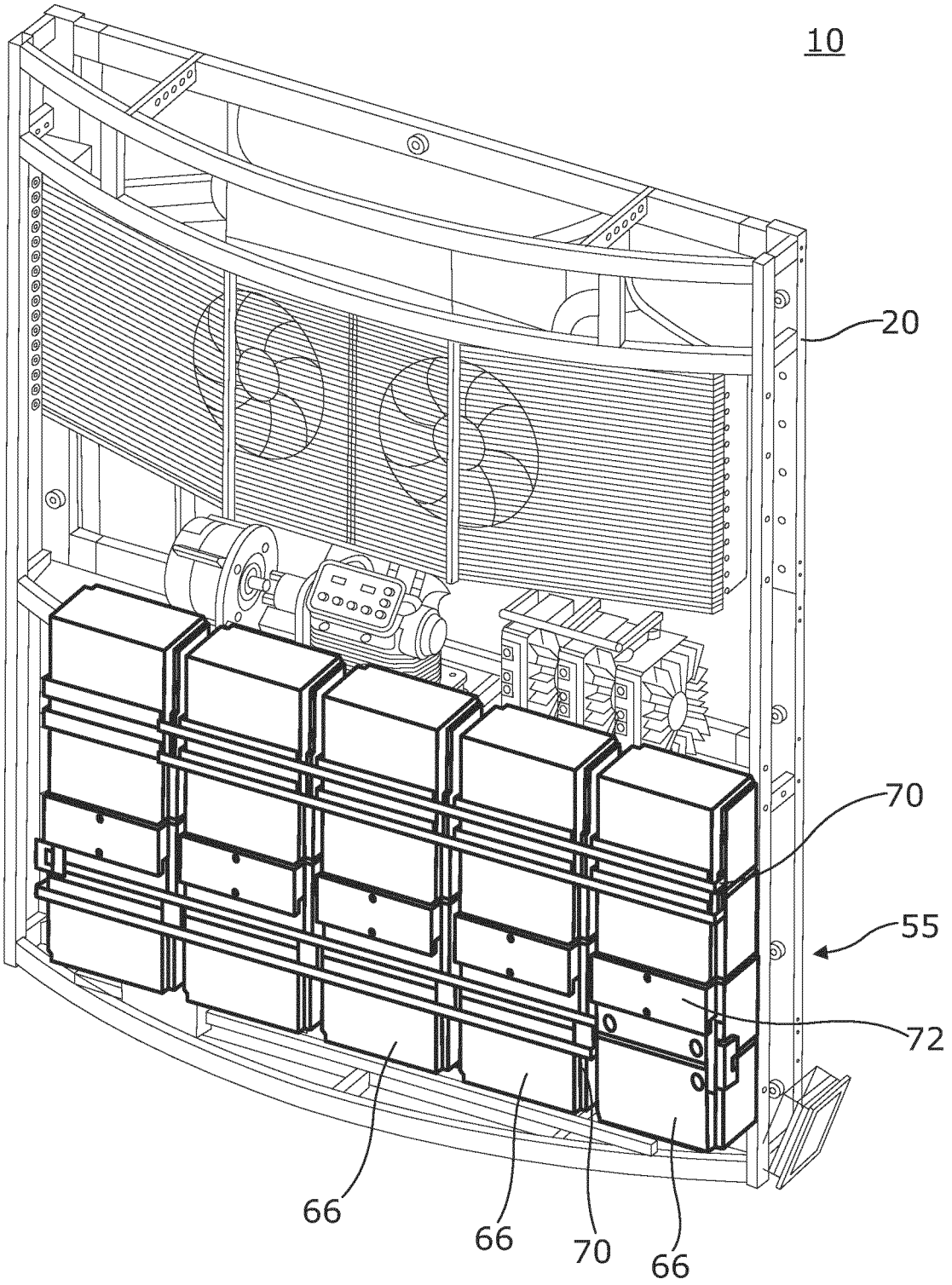
FIG. 4 shows a front perspective view showing the positioning of the battery modules in the TRU.

FIG. 3A shows the cell stack (i.e. battery module) in an orientation with the contacts on top, such as might be found in an EV or similar where an array of batteries might extend across the floor of the chassis. As shown in FIG. 4, in the present TRU, plural cell stacks are received by the battery rack (here in a 5 by 4 array giving a total capacity of 50 kWh) orientated such that the contacts are at the front. Bus-bars 70 extend across the front of the cell stacks connecting them together in series and/or parallel as required by the application. A battery management system 72 for the overall collection of cell stacks may also be provided.

Figure 5A:
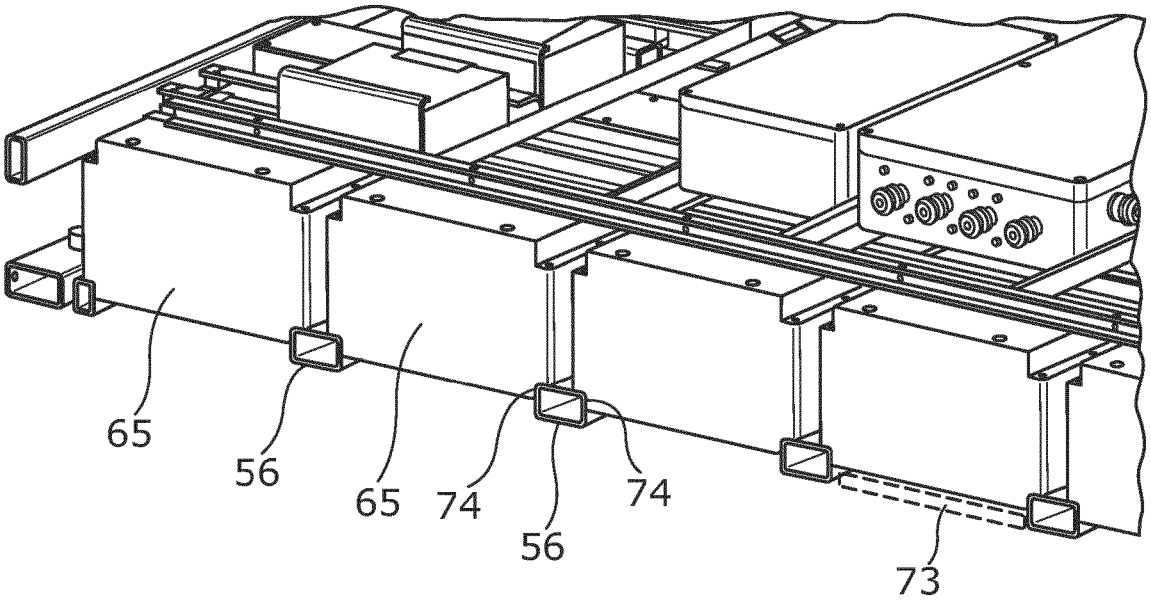
FIG. 5A shows a horizontal cross-sectional view of the TRU showing the arrangement of battery modules and elements of the support framework.
Figure 5B:
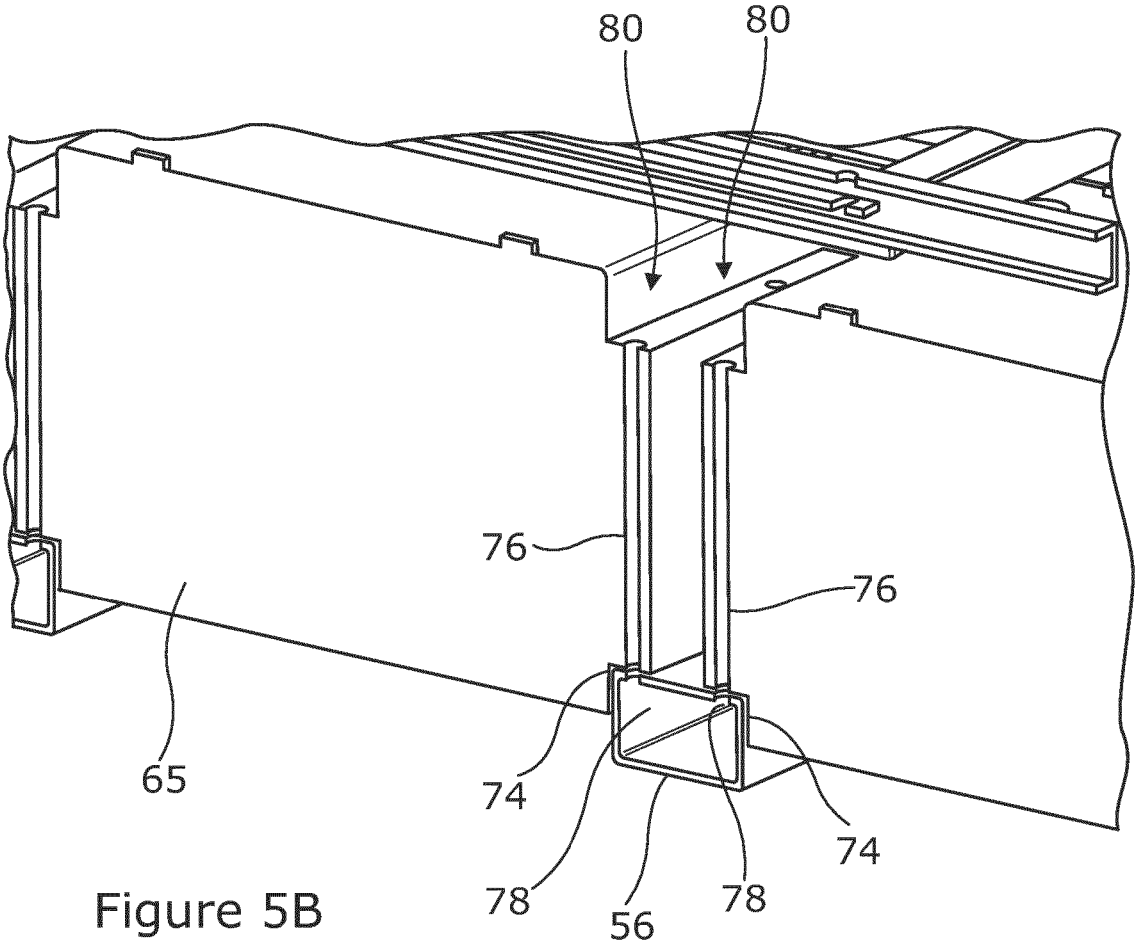
FIG. 5B shows a detail horizontal cross section through a battery module and support framework through a mounting hole.

FIGS. 5A and 5B show the mounting arrangement for the cell stacks in more detail. As shown by FIG. 5A, the cell stacks have recessed side edges 74 in the aluminum enclosure 68. The rear support members 74 are spaced laterally apart such that each adjacent pair receives a cell stack between them with the member fitting 74 into the recesses 74 of the adjacent cell stacks. This allows the cells of the cell stacks to be partially recessed in between the support members. FIG. 5B shows a cross section coinciding with attachment points in the cell stacks and battery support members. The aluminum enclosures of the cell stacks have through holes 76 running front to back at the sides of the cell stack enclosure starting and ending in a recessed portion 74. These line up with holes 78 in the battery support member. Bolts or other fixtures (not shown for clarity) may pass through 80 the holes 76 and attach to the corresponding holes 78 in the battery support member 56 to fix the cell stack 65 in position. Various forms for the fixings may be used, but preferably they are accessible at the front of the battery module for the operator (e.g. installer or person in manufacturing plant) to engage, whilst attaching to the vertical support members at the rear of the battery module via some mechanism that extends through the battery module, which may be as simple as a rod or bolt passing through the module. Typically fixings are provided at the four corners of the cell stack at least to provide a secure mounting.

In some examples, the battery support members 74 are laterally movable, i.e. can be detached, repositioned and reattached to the cross members in greater or fewer numbers, so that the TRU can accommodate different widths of battery module. In some instances, where a single large battery module was used, all intermediary support members 74 can be removed entirely, just leaving support members 74 at the sides of the framework to support the battery module. Thus, to mount the battery module, it is introduced into the battery rack from the front and advanced rearwardly until it is positioned between two support members, and the bolts extending through the holes in the sides of the battery modules tightened to clamp the battery module to the supports.

Thus, each cell stack is independently clamped to the rear battery support members, where by those fixing points define virtual "slots" for each battery in the rack, whilst avoiding the additional wall material to define physical slots, and so maximize the space for batteries. Each battery can be positioned very closely adjacent to its neighbors and if desired a small air gap can be maintained. Accordingly, when the TRU is installed in an upright position, no cell stack bears the weight of the cell stack(s) above it. Furthermore, as shown in FIG. 8, the cell stacks are orientated such that the prismatic cells are side by side (e.g. like books on a bookshelf) such that no prismatic cell is bearing the weight of other prismatic cells. Thus, each of the 120 cells in this example are independently supported of each other, i.e. not supported by any other cell. This is a particular advantage of the present arrangement, as cells are typically heavy, e.g. between 1 kg and 3 kg, and cells would not be able to support the weight of other cells bearing down on them without suffering damage or degraded performance. The present mounting arrangement avoids this, whilst allowing the cells to be mounted in a vertical plane (unlike a horizontal plane as is typically found in EVs where such problems do not exist).

If required, the space 73 between battery support members 56 could be used to accommodate thermal management plates 73 (an example of which is shown in cross section in FIG. 5A) affixed to the support members 56 and in thermal contact with the bottom surface of the cell stack/cells. This allows thermal conditioning of the batteries to ensure they remain close to room temperature where they perform well. Thermal management plates can provide cooling as well as heating depending on the fluid made to circulate inside the plates. Thermal management plates, e.g. cold plates, used to cool batteries, e.g. in EVs, are generally known in the art and are not described in detail herein. The fluid made to circulate inside the plates may be linked with the refrigeration system or may be separate.

Referring to FIG. 8, this provides a very compact way of mounting batteries in a vertical plane which maximizes the battery volume. Furthermore, the front of the battery rack is completely open and unobstructed by support members, such that access can easily be made to insert and fix batteries in position in the defined slots via the mounting bolts. Compared with known TRUs the support members 48 are positioned relatively further outboard, i.e. towards the sides of the battery rack, to provide an unobstructed open face to the battery modules and making the open face wide enough to optimize the battery volume, whilst still providing effective bracing to the overall TRU. Preferably these support members 48 are distanced from the sides of the framework by no more than 20% of the width of the framework, and more preferably, by no more than 10% of the width of the framework, and even more preferably, by not more than 5% of the width of the framework.

Figure 10A:
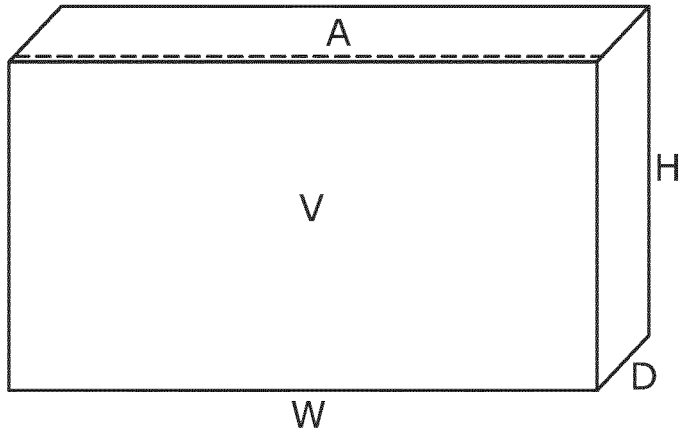
FIG. 10A shows the dimensions of the battery volume of FIG. 8.
Figure 10B:
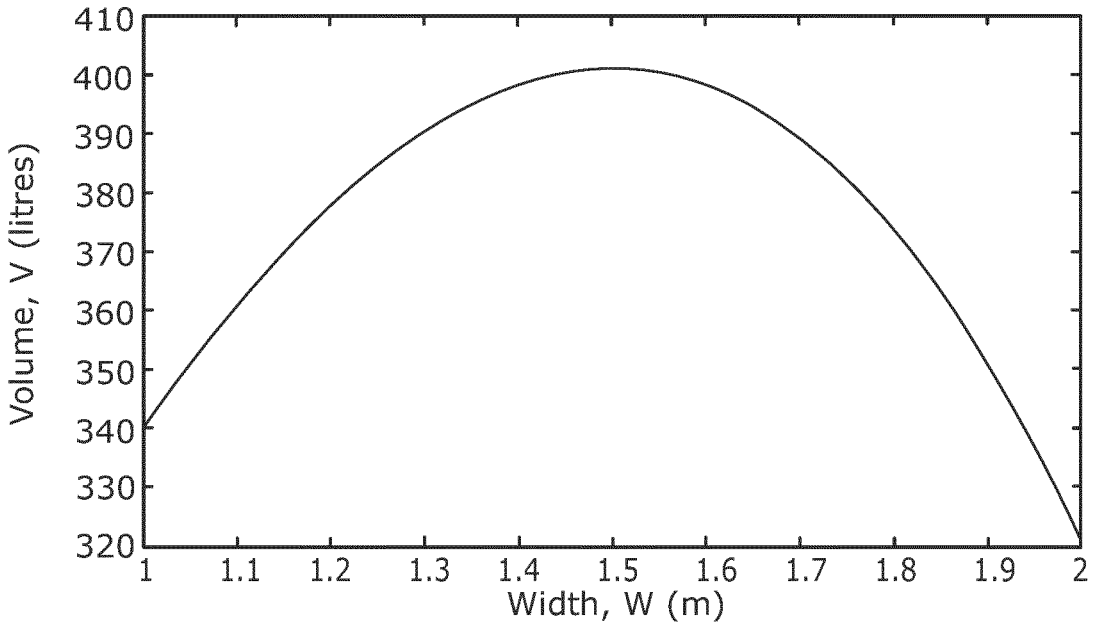
FIG. 10B shows the relationship between the battery volume and various constraints.

FIG. 10A shows the battery volume dimensions for a single layer of battery modules as per FIG. 8, and FIG. 10B shows the relationship between volume V and the width W using typical dimensions.

The depth D of the battery module can be established as a function of the width W by the following equation (based on Pythagoras' theorem), i.e.:

$$D = SQRT(R^2 - (W/2)^2) - L \quad 1)$$

Thus, the Area A is given by W.D, i.e.

$$A = W \cdot (SQRT(R^2 - (W/2)^2) - L) \quad 2)$$

and the Volume V is given by H.A, i.e.

$$V = H \cdot W \cdot (SQRT(R^2 - (W/2)^2) - L) \quad 3)$$

FIG. 10B plots this relationship with the maximum allowable radius from the kingpin R=2.04 m, the distance from the kingpin to the front of the trailer L=1.6 m and the height of the battery module H is 0.9 m.

It can be seen that the depth D of the battery modules is important in maximizing the available volume V given the curved front surface of the available volume dictated by the maximum radius R from the kingpin 60. In particular, the depth of the battery modules determine the point 95 where the edges of the battery volume meet the curved surface of the TRU volume. If they are too deep, then battery modules cannot extend very far towards the sides and can only be positioned centrally where the volume has maximum depth, and so the overall battery volume is curtailed by the lack of width (W). Conversely, if the battery modules are thin, they can extend further towards the sides whilst staying in the available volume, but the overall battery volume is now curtailed by the lack of depth (D). It can be seen from FIG. 10B that for a single layer of similarly sized battery modules, an optimum depth can be found between these extremes that maximizes the battery volume in the available space. The precise relationship is given by the equation plotted in FIG. 10B. In the present example the cell stacks have a volumetric energy density of 217 Wh/liter. Accordingly, by selecting the maximum of 400 liters when W=1.5 m (which gives D=0.3 m from equation 1), the total energy capacity of the battery would be 86.8 kWh.

In most cases, good results may be obtained by using a width W that is within 20% greater or lesser of the optimum value obtained in this way.

However, this optimum is not always possible because the depth D is given by the height of the cells. The theoretical optimum can therefore often not be achieved as battery cells (the size of them) may be dictated from other requirements. It can be seen that, where the choice of battery depth D is limited, equation 1 can be rewritten so the width W is in terms of the depth D, and hence similarly equations 2 and 3 can be rewritten to give the Area A and Volume V in terms of the depth D. Accordingly, the Volume can be plotted as a function of depth D, and the optimum Volume obtained for the battery depth D or depths that are available, from which the width W is then obtained via equation 1.

In most cases, it is preferred that the depth of a single battery module is between 20% and 80% of the maximum depth of the TRU. In most cases, this translates into the battery modules extending across between 50% and 90% of the width of the trailer.

In other examples, more than one layer of battery modules with a smaller depth D may be provided in the volume, but this potentially makes accessibility for those batteries in the rear layers more difficult. The optimum width W of the rearmost layer is obtained for the chosen battery depth D using the embodiments described above. The optimum width for the next layer is they found by adjusting the distance from the kingpin L by subtracting the chosen battery depth of the first layer. Equally, the equations for a volume of multiple layers can be added together to determine a total volume which can be optimized using a similar approach to the single layer.

Figure 6:
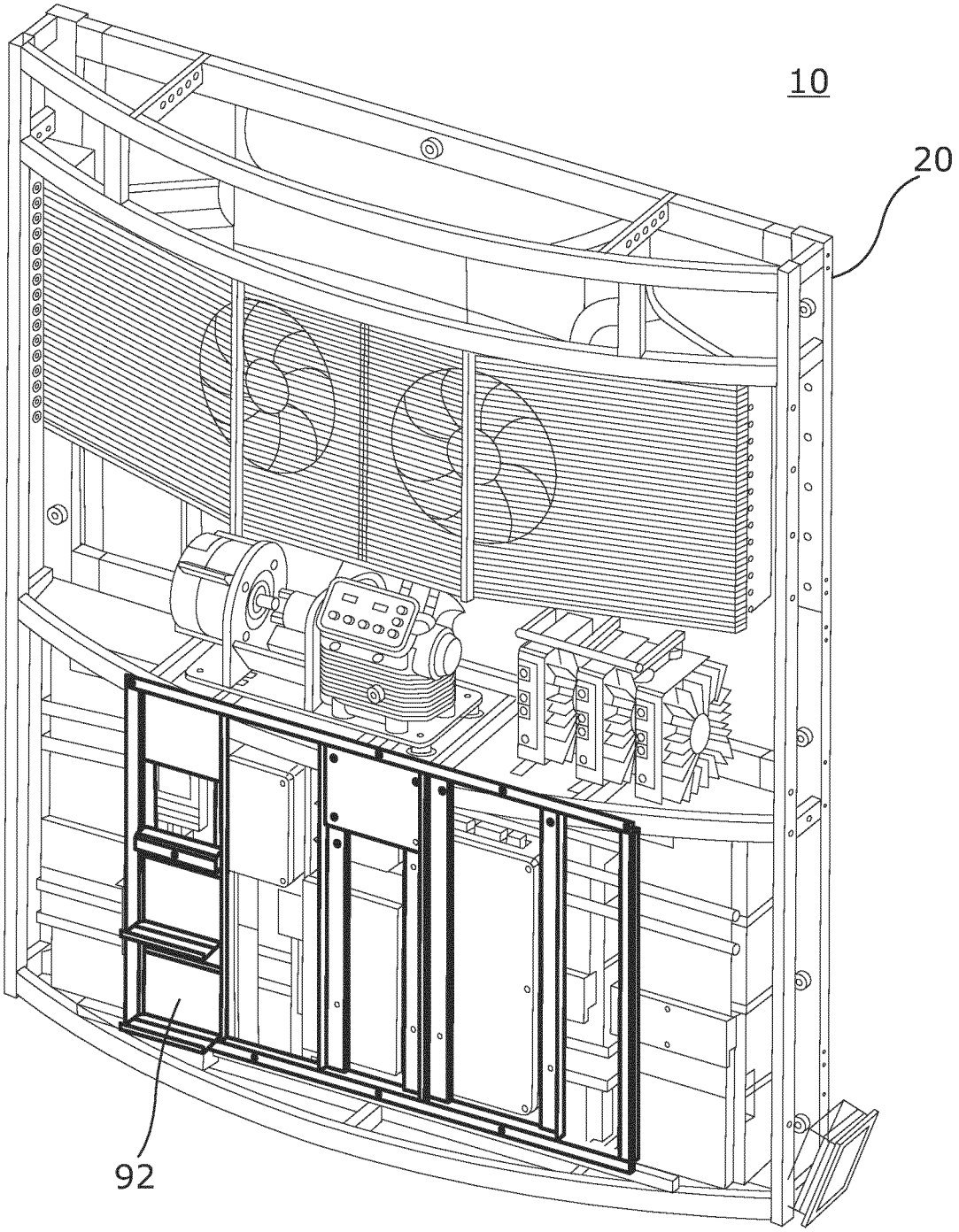
FIG. 6 shows an electronics sub-frame of the TRU.
Figure 7:
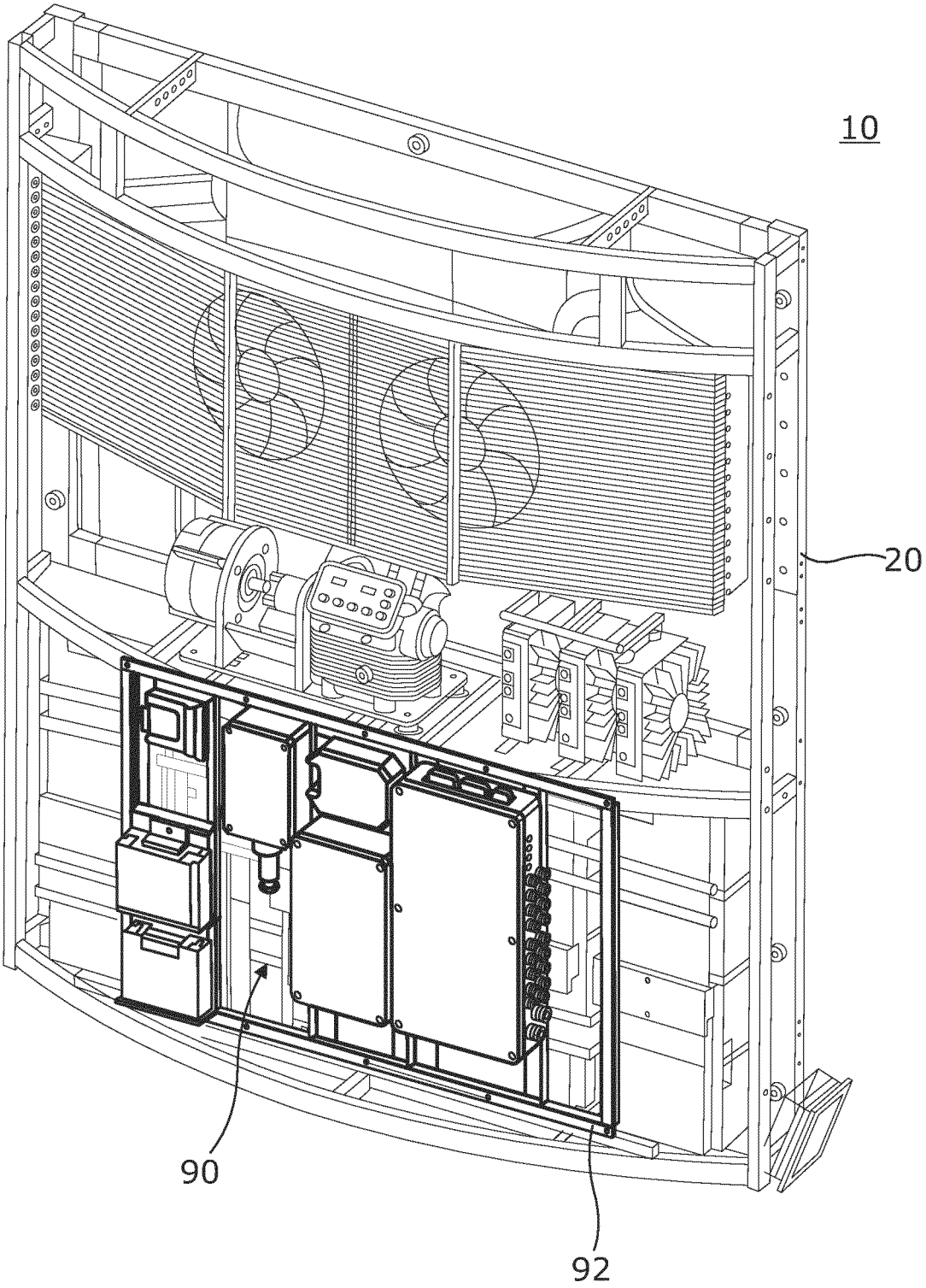
FIG. 7 shows the electronics mounted to the mount of FIG. 6.

Referring again to FIG. 8, it can be seen that given a preferred battery depth, additional space is available centrally in front of the battery rack. This space is preferably used to accommodate the power electronics 90. As shown in FIG. 6, a sub-frame 92 for supporting the power electronics 90 is movably or detachably fixed to the framework 20, in this example to rails 58, in front of the battery racking space connecting to the cross members 58. This may be bolted in place, or hinged or use any convenient method of fixing. FIG. 7 shows the power electronics 90 supported by the sub-frame 92, comprising power electronics, system controllers for managing the refrigeration system and managing the batteries charging/discharging, etc., communication means to remote software that manages the batteries or to provide a HMI 91 (shown in FIG. 1) to alert an operator as to the status of the unit. Preferably, the sub-frame 92 fixings are accessible with the power electronics 90 mounted such that the entire sub-frame 92 can be removed or moved out of the way with the power electronics 90 still attached to allow easy access to the battery rack behind it. For instance the sub-frame may be hinged to the rails 58 so it swings out of the way to allow access to the batteries behind. As shown in FIG. 8, with the sub-frame removed, the entirety of the battery rack face is preferably unobstructed from the front.

In some examples, a subset of battery modules, e.g. at the sides, are accessible even when the power electronics sub-frame 92 is in place, allowing those battery modules to be unfastened and removed. This may be useful where the TRU is arranged to operate with a variable number of battery modules, i.e. to provide adaptive battery capacity according to the delivery cycle for the TRU, by allowing some batteries to be swapped in and out of the unit even more easily.

Figure 9:
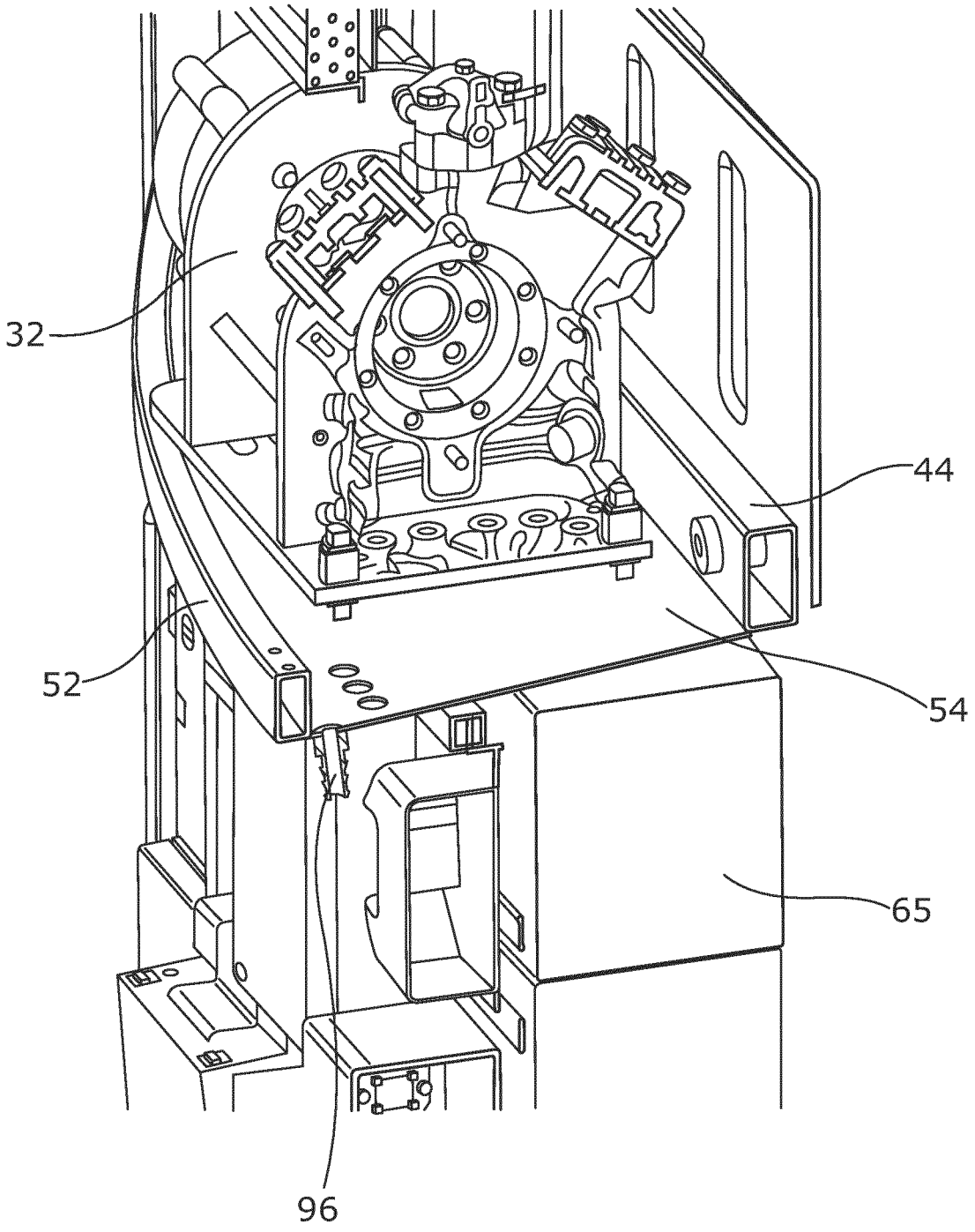
FIG. 9 shows a vertical cross section showing a tray of the TRU.
Figure 11:
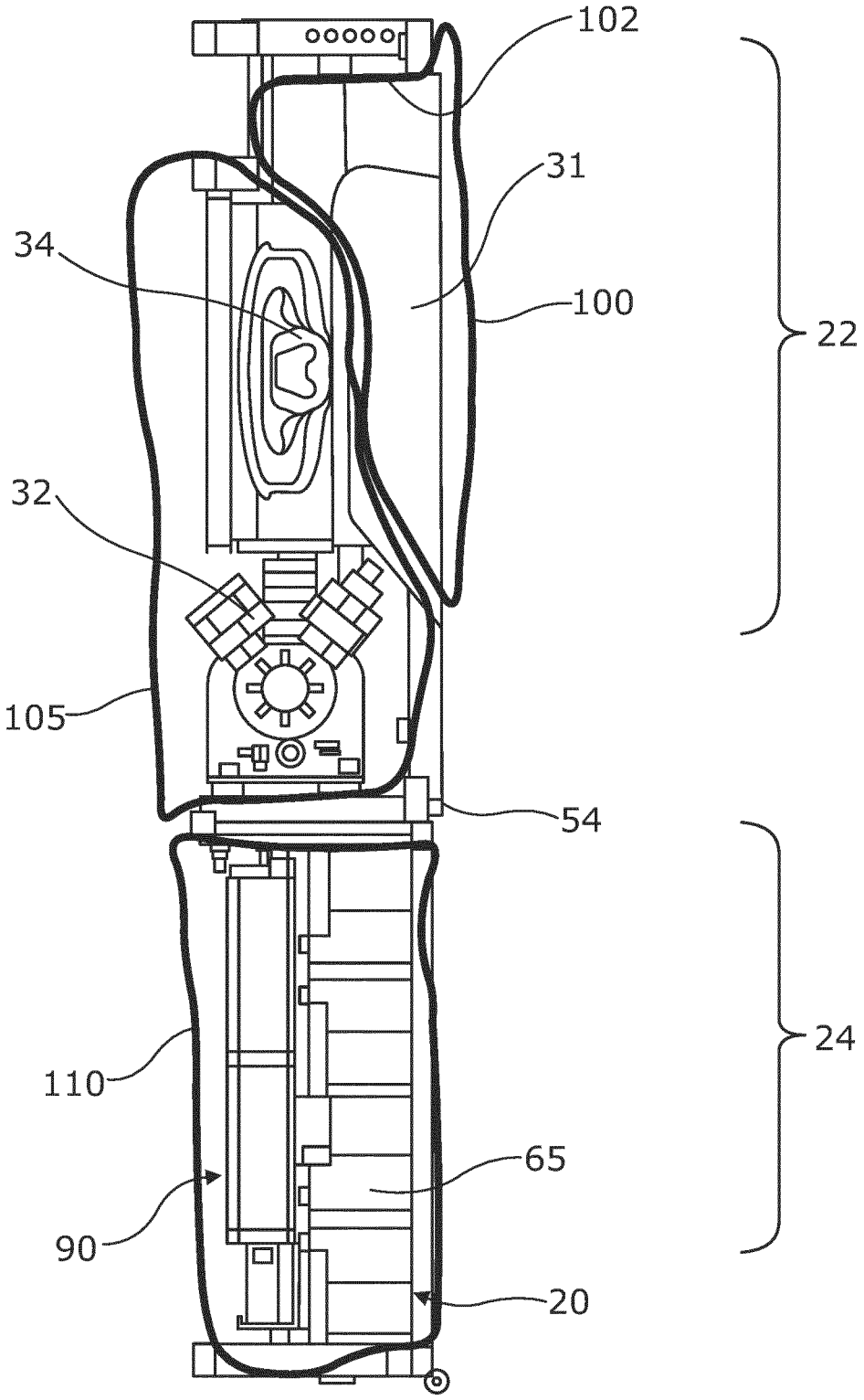
FIG. 11, shows a vertical cross section of the TRU showing the division between the wet zone and dry zones.

As shown in FIG. 9, the tray 54 formed between the top and bottom compartments is arranged to collect any water present in the top compartment and channel it away via outlets 96 and hoses (not shown) running through the bottom compartment and therefore bypassing the bottom compartment. Thus, as shown by the cross section of FIG. 11, various zones are created within the TRU 10. At the top, a shroud 102 separates the evaporator fans 31 and airflow to and from the trailer from the rest of the TRU. This internal zone 100 can be thought of as an extension of the interior of the trailer where the evaporator 31 is located. Outside this zone 100, a "wet zone" 105 is formed in the top compartment, in which at least the compressor 34 and condenser 34 may be located. Since the refrigeration system must exchange air with the outside environment, i.e. to provide airflow across the condenser heat exchangers 34*a* and cooling airflow to the chargers 33, this is necessarily open to the atmosphere to some degree and can therefore be expected to get wet in adverse weather conditions. However, the provision of the tray 54 completely separating the top and lower compartments, protects the lower compartment 24 forming a "dry zone" 110 to protect moisture sensitive components, i.e. the power electronics 90 and battery modules 65.

The members used for the framework may be made from aluminum box section of appropriate dimensions. The overall TRU may weigh between 500 kg and 1000 kg or more. Although this is heavy compared with conventional diesel TRUs, the electrical TRU is not subject to vibrations from the ICE, and so less strength is needed in the support members. Accordingly, unlike conventional diesel TRUs, it has been found that aluminum members are suitable for the framework and that it is not necessary to use steel members for the framework, allowing weight to be saved.

Embodiments of the present disclosure have been described with particular reference to the examples illustrated. However, it will be appreciated that variations and modifications may be made to the examples described within the scope of the present claims.

The invention claimed is:

1. An electric refrigeration unit, comprising:

a framework configured to attach to a mobile enclosure;

a refrigeration system including an evaporator and condenser configured to cool and/or heat an interior of the mobile enclosure; and one or more rechargeable battery modules configured to provide a primary source of power to the refrigeration system, wherein the framework supports the refrigeration system and the battery modules, defining a first compartment in which the refrigeration system, including the evaporator and the condenser, is located, the condenser having fans and being open to an atmosphere to provide airflow, and a second compartment in which the one or more battery modules are located, and wherein the first compartment is located above the second compartment and completely separated by a tray configured to collect liquids that collect in the first compartment and drain the collected liquids away from the second compartment such that the battery modules in the second compartment remain dry.

2. The electric refrigeration unit of claim 1, wherein the battery modules comprise plural battery cells in a side by side arrangement when the modules are fixed in the electric refrigeration unit.

3. The electric refrigeration unit of claim 1, comprising at least one busbar, configured to extend across a front face of the battery modules to make electrical connections to plural battery modules.

4. The electric refrigeration unit of claim 1, wherein the battery modules are arranged in one or more arrangements selected from:

an array of plural rows and columns; and plural layers of one or more battery modules front to back, wherein a front layer optionally has a reduced width compared with a rear layer.

5. A method of providing a temperature controlled payload at a destination using the unit of claim 1, comprising powering the refrigeration system with the one or more battery modules to control a temperature of a payload in the mobile enclosure whilst transporting it to a destination.

6. An electric refrigeration unit, comprising:

a framework configured to attach to a mobile enclosure;

a refrigeration system configured to cool and/or heat an interior of the mobile enclosure; and plural rechargeable battery modules configured to power the refrigeration system, wherein the framework supports the refrigeration system and the battery modules, defining a first compartment in which the refrigeration system is located and a second compartment in which the battery modules are located, wherein the framework comprises one or more of:

a battery racking space, wherein a front face of the battery racking space is open or configured to open to enable access to the plural battery modules, wherein the battery modules are arranged in a vertical array of plural rows and plural columns; and battery support members at a rear of the electric refrigeration unit, wherein each battery module is individually fixed to the battery support members.

7. The electric refrigeration unit of claim 6, wherein at least one fastener fixes the battery module to the battery support members at the rear of the battery module, wherein the at least one fastener is accessible to an operator at a front of the battery module.

8. The electric refrigeration unit of claim 7, wherein each fastener comprises a member that passes through a through hole or recess in a side casing of the battery module from front to rear.

9. The electric refrigeration unit of claim 8, wherein plural battery modules are independently supported one above the other in a column such that no battery module bears a weight of any other battery module in that column.

10. The electric refrigeration unit of claim 6, comprising at least three laterally spaced support members with two columns of battery modules supported between adjacent pairs of support members.

11. The electric refrigeration unit of claim 6, wherein a sub-frame movably or removably attaches to the framework across the front face of the battery racking space to support electronics and/or additional battery modules.

12. The electric refrigeration unit of claim 11, wherein the framework comprises interconnected vertical and cross members defining a rear framework portion to attach to a trailer, and wherein the electric refrigeration unit comprises vertical side support members at each side of the electric refrigeration unit spaced forwardly of and connected to the rear framework to brace the framework.

13. The electric refrigeration unit of claim 12, wherein the framework further comprises curved cross members to connect the side support members.

14. The electric refrigeration unit of claim 13, wherein the curved cross members are concentric with a constant radius from a king pin connection to the trailer.

15. The electric refrigeration unit of claim 12, wherein the vertical side support members are positioned outboard of lateral boundaries of the battery racking space such that the battery racking face is not obstructed by the vertical side support members.

16. The electric refrigeration unit of claim 15, wherein the battery racking space does not extend laterally as far as the rear vertical members of the framework leaving a gap through which mounting fixtures of the rear vertical members can be accessed to fix the electric refrigeration unit to the enclosure.

17. The electric refrigeration unit of claim 11, wherein the sub-frame has a hinged connection to the framework or is otherwise detachable to allow it to be moved to access the one or more battery modules.

18. The electric refrigeration unit of claim 6, wherein a heat exchange plate is mounted in-between the battery support members and in thermal contact with the battery modules, wherein the heat exchange plate is configured to thermally condition the batteries.

* * * * *